US006283199B1

(12) United States Patent
Nakamura et al.

(10) Patent No.: US 6,283,199 B1
(45) Date of Patent: Sep. 4, 2001

(54) HEAT EXCHANGER

(75) Inventors: Youichi Nakamura; Kimiaki Nakano, both of Hadano (JP)

(73) Assignee: Toyo Radiator Co., Ltd., Tokyo (JP)

( * ) Notice: Subject to any disclaimer, the term of this patent is extended or adjusted under 35 U.S.C. 154(b) by 0 days.

(21) Appl. No.: 09/571,861

(22) Filed: May 16, 2000

(30) Foreign Application Priority Data

May 20, 1999 (JP) ..... 11-139922

(51) Int. Cl.[7] ..... F28F 7/00; F28F 3/00
(52) U.S. Cl. ..... 165/81; 165/167; 165/178
(58) Field of Search ..... 165/81, 178, 82, 165/167

(56) References Cited

U.S. PATENT DOCUMENTS 4,263,964 * 4/1981 Masai et al. ..... 165/82 X
4,291,752 * 9/1981 Bridgnell ..... 165/81
6,119,766 * 9/2000 Blomgren ..... 165/81

FOREIGN PATENT DOCUMENTS

2453961 * 5/1976 (DE) ..... 165/81
62-242791 * 10/1987 (JP) ..... 165/167

* cited by examiner

*Primary Examiner*—Leonard Leo
(74) *Attorney, Agent, or Firm*—Sughrue, Mion, Zinn, Macpeak & Seas, PLLC

(57) ABSTRACT

A heat exchanger is provided with a casing (5) in which a heat exchanger core (3) is received. The core (3) is provided with a pair of inlet/outlet convex portions (1) in its opposite end portions. These pipes (1) pass through the casing (5) to project outward. The heat exchanger is capable of sufficiently absorbing any difference in thermal expansion between its components such as the casing (5) and the core (3), which is realized by the provision of a bellows (6) fluid-tightly interposed between at least one of the inlet/outlet convex portions (1) of the core (3) and a corresponding one of a pair of through-hole portions (4) of the casing (5)

3 Claims, 3 Drawing Sheets

HEAT EXCHANGER

BACKGROUND OF THE INVENTION

1. Field of the Invention

The present invention relates to a heat exchanger provided with a casing, received in which casing is a heat exchanger core provided with a pair of inlet/outlet convex portions in its opposite end portions, wherein the core has its inlet/outlet convex portions project outward from the casing, and a difference in thermal expansion between the casing and the core is adequately absorbed in the heat exchanger.

2. Description of the Related Art

A conventional heat exchanger is provided with a casing, which receives therein a heat exchanger core. A pair of inlet/outlet convex portions, for example such as inlet/outlet pipes and their corresponding boss portions in which the inlet/outlet pipes are mounted, are provided in opposite longitudinal end portions of the core. The inlet/outlet convex portions or pipes pass through the casing through a pair of through-hole portions of the casing, are brought into fluid-tight contact therewith and fixedly mounted therein through a suitable fixing means such as soldering and the like. A first fluid is introduced into the core through these inlet/outlet pipes. On the other hand, a second fluid is introduced into the casing so that the exchange of heat between the first and the second fluid is conducted in the conventional heat exchanger.

Now, the problem to be solved by the present invention will be described.

In the conventional heat exchanger having the above construction, for example, cold water which serves as the second fluid is introduced into the casing. On the other hand, hot fluid serving as the first fluid is introduced into the core. Under such circumstances, the casing reaches substantially the same temperature as that of the cold water. On the other hand, the core reaches substantially the same temperature as that of the hot fluid. In this case, the core is larger in thermal expansion than the casing, which causes thermal stresses to concentrate in root portions of the inlet/outlet pipes. Consequently, due to such concentration of the thermal stresses, there is a fear that a crack is produced in the root portions of the inlet/outlet pipes in use.

SUMMARY OF THE INVENTION

Consequently, it is an object of the present invention to provide a heat exchanger, which is provided with means for absorbing any difference in thermal expansion between its components, wherein the means is simple and compact in construction to realize the heat exchanger high in reliability and large in crack-resistance properties.

In accordance with a first aspect of the present invention, the above object of the present invention is accomplished by providing:

A heat exchanger comprising:

a core (3) provided with a pair of inlet/outlet pipe portions (1) or a pair of inlet/outlet convex portions (1) such as a pair of inlet/outlet boss portions and the like for receiving therein the inlet/outlet pipe portions (1), wherein the inlet/outlet pipe portions (1) or the inlet/outlet convex portions (1) are longitudinally spaced apart from each other on an outer peripheral surface of the core (3);

a casing (5) for receiving therein the core (3), wherein the casing (5) is provided with a pair of through-hole portions (4) which are brought into liquid-tight contact with the inlet/outlet convex portions (1) of the core (3), wherein a first fluid (17) and a second fluid (18) are introduced into the core (3) and the casing (5), respectively, to perform heat exchange between the first fluid (17) and the second fluid (18); and a bellows (6) interposed between at least one of the inlet/outlet convex portions (1) of the core (3) and a corresponding one of the through-hole portions (4) of the casing (5) to realize fluid-tight contact between the bellows and each of the one of the inlet/outlet convex portions (1) of the core (3) and the corresponding one of the through-hole portions (4) of the casing (5), wherein the bellows (6) permits the one of the inlet/outlet convex portions (1) of the core (3) to move relative to the corresponding one of the through-hole portions (4) of the casing (5) in a radial direction of the corresponding one of the through-hole portions (4) of the casing (5).

In the heat exchanger having the above construction, preferably, a short sleeve portion (7) larger in diameter than the one of the inlet/outlet convex portion (1) of the core (3) is provided in a position corresponding to that of the corresponding one of the through-hole portions (4) of the casing (5); the short sleeve portion (7) of the casing (5) has its front-end opening portion brought into fluid-tight contact with one of opposite ends of the bellows (6), the other one of the opposite ends of the bellows (6) being brought into fluid-tight contact with the one of the inlet/outlet convex portions (1) of the core (3).

In accordance with a second aspect of the present invention, the above object of the present invention is accomplished by providing:

A heat exchanger comprising:

a core (3) provided with a pair of inlet/outlet pipe portions (1) or a pair of inlet/outlet convex portions (1) such as a pair of inlet/outlet boss portions and the like for receiving therein the inlet/outlet pipe portions (1), wherein the inlet/outlet pipe portions (1) or the inlet/outlet convex portions (1) are longitudinally spaced apart from each other on an outer peripheral surface of the core (3); and a casing (5) for receiving therein the core (3), wherein the casing (5) is provided with a pair of through-hole portions (4) which are brought into liquid-tight contact with the inlet/outlet convex portions (1) of the core (3), wherein a first fluid (17) and a second fluid (18) are introduced into the core (3) and the casing (5), respectively, to perform heat exchange between the first fluid (17) and the second fluid (18), wherein the casing (5) is provided with an insertion portion **(4*a*) an inner diameter of which is sufficiently larger than an outer diameter of the one of the inlet/outlet convex portions (1) of the core (3) to permit the one of the inlet/outlet convex portions (1) of the core (3) to project outward through the insertion portion (4*a*) of the casing (5), wherein an edge portion of the insertion portion (4*a*) of the casing (5) is brought into fluid-tight contact with one of opposite ends of a bellows (6) which has the other of its opposite ends brought into fluid-tight contact with an outer peripheral portion of the one of the inlet/outlet convex portions (1) of the core (3)**.

In the heat exchanger having the above construction, preferably, the short sleeve portion (7) of the casing (5) is provided with an inner flange portion (8) of the casing (5) in its root portion; and, a holding means (9, 15) for slidably holding the inner flange portion (8) of the casing (5) is provided in the root portion of the one of the inlet/outlet convex portions (1) of the core (3).

Further, preferably, the short sleeve portion (7) of the casing (5) assumes a circular truncated cone shape.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

The best modes for carrying out the present invention will be described in detail using embodiments of the present invention with reference to the accompanying drawings.

Figure 1:
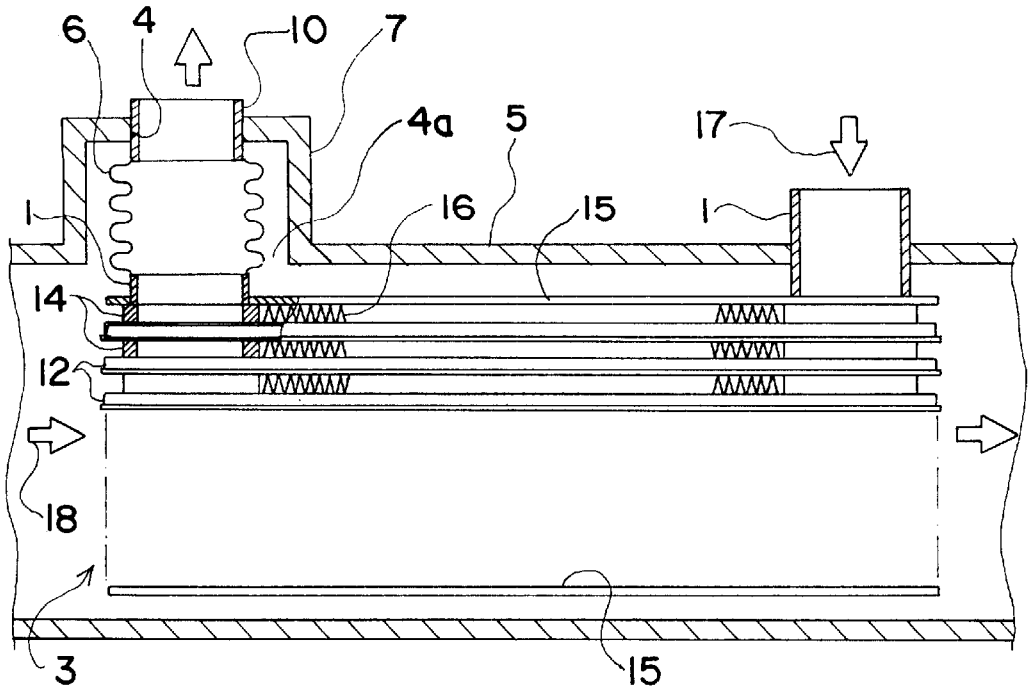
FIG. 1 is a longitudinal sectional view of a first embodiment of the heat exchanger of the present invention.
Figure 2:
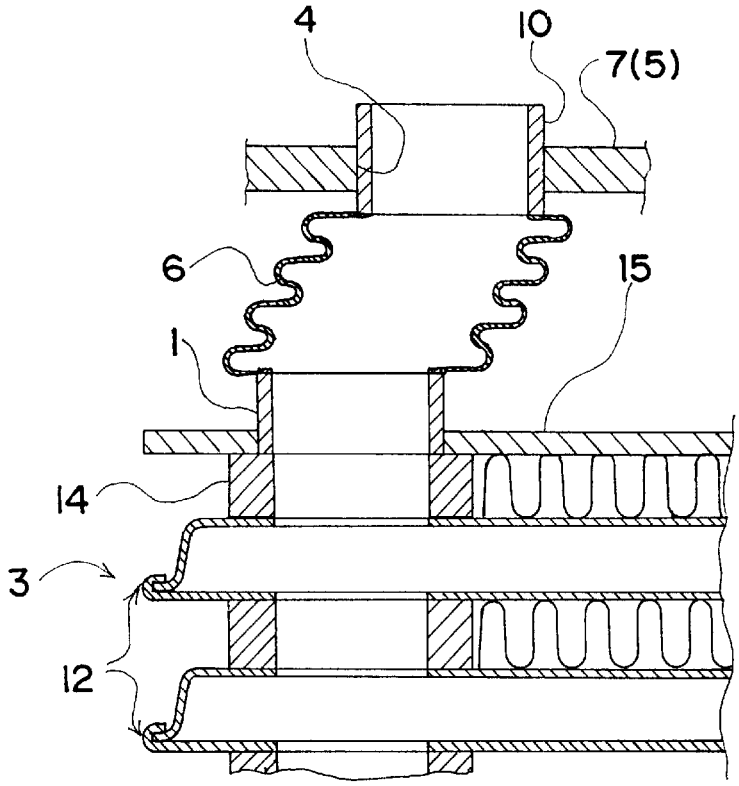
FIG. 2 is an enlarged longitudinal sectional view of an essential part of the first embodiment of the heat exchanger of the present invention shown in FIG. 1 in use.

FIG. 1 shows a first embodiment of a heat exchanger of the present invention. FIG. 2 shows deformation in a bellows 6 of the heat exchanger of the present invention shown in FIG. 1.

The heat exchanger of the present invention is provided with a core 3 which is of a multi-plate type, in which: a pair of dish-like metallic plates each provided with a pair of communication holes in its opposite end portions have their peripheral edge portions brought into fluid-tight contact and connected with each other to form an heat exchanger element 12; a plurality of the thus formed elements 12 are stacked together into a pile, and connected with each other through their communication holes. As shown in FIG. 1, such a pile thus formed has its top portion covered with an upper end plate 15. This upper end plate 15 of the core 3 is provided with a pair of openings in its opposite end portions, in which openings a pair of inlet/outlet convex portions 1 are fixedly mounted to project upward as viewed in FIG. 1. Incidentally, the above-mentioned pile has its bottom portion covered with a lower end plate having no communication hole, so that the core 3 is formed. As is clear from FIG. 1, an outer fin 16 is interposed between adjacent ones of these heat exchanger elements 12.

In this first embodiment of the heat exchanger of the present invention shown in FIGS. 1 and 2, each of the inlet/outlet convex portions 1 of the core 3 is constructed of a small-diameter pipe. A right-hand one of these inlet/outlet convex portions or pipes 1 as viewed in FIG. 1 is fixedly mounted in a corresponding one of a pair of through-hole portions 4 of the casing 5 by means of soldering and like fastening means, so that this right-hand one is brought into fluid-tight contact with the corresponding one of the through-hole portions 4 of the casing 5. On the other hand, a left-hand one of the inlet/outlet convex portions or pipes 1 of the core 3 has its upper end portion connected with a lower end portion of the bellows 6 interposed between the left-hand one of the inlet/outlet convex portions or pipes 1 and a short pipe 10. As shown in FIG. 1, this short pipe 10 has its upper end portion brought into fluid-tight contact with a top through-hole portion 4 of a short sleeve portion 7 of the casing 5 and fixedly mounted in this top through-hole portion 4 by means of soldering and like fastening means.

The short sleeve portion 7 of the casing 5 is provided in an outer peripheral surface of the casing 5 in a position corresponding to that of the left-hand one of the inlet/outlet convex portions 1 of the core 3 to project radially outwardly therefrom. An inner diameter of the short sleeve portion 7 of the casing 5 is sufficiently larger than an outer diameter of the bellows 6 to permit the bellows 6 to deform laterally.

A hot oil serving as a first fluid 17 is introduced into the individual heat exchanger elements 12 of the core 3 through a right-hand one of the inlet/outlet convex portions 1 of the core 3, as shown in FIG. 1. Such a first fluid or hot oil 17 thus passed through the core 3 is then discharged out of the left-hand one of the inlet/outlet convex portions 1 of the core 3. On the other hand, as viewed from FIG. 1, cold water serving as a second fluid 18 is introduced into the casing 5 from a left-hand inlet opening (not shown), passes through the casing 5, and is then discharged from a right-hand outlet opening (not shown) of the casing 5, wherein heat exchange is performed between the hot oil serving as the first fluid 17 and the cold water serving as the second fluid 18. At this time, a difference in thermal expansion appears between the each of the elements 12 of the core 3 and the casing 5. Such difference in thermal expansion therebetween is absorbed by deformation of the bellows 6, as shown in FIG. 2. Incidentally, such deformation of the bellows 6 shown in FIG. 2 is exaggerated for the purpose of illustration. An actual amount of such deformation of the bellows 6 is very small in most cases. In any case, the bellows 6 is capable of absorbing any difference in thermal expansion between the components of the heat exchanger of the present invention to reduce thermal stresses imposed on base portions (i.e., root portions) of the inlet/outlet convex portions 1 of the core 3.

Figure 3:
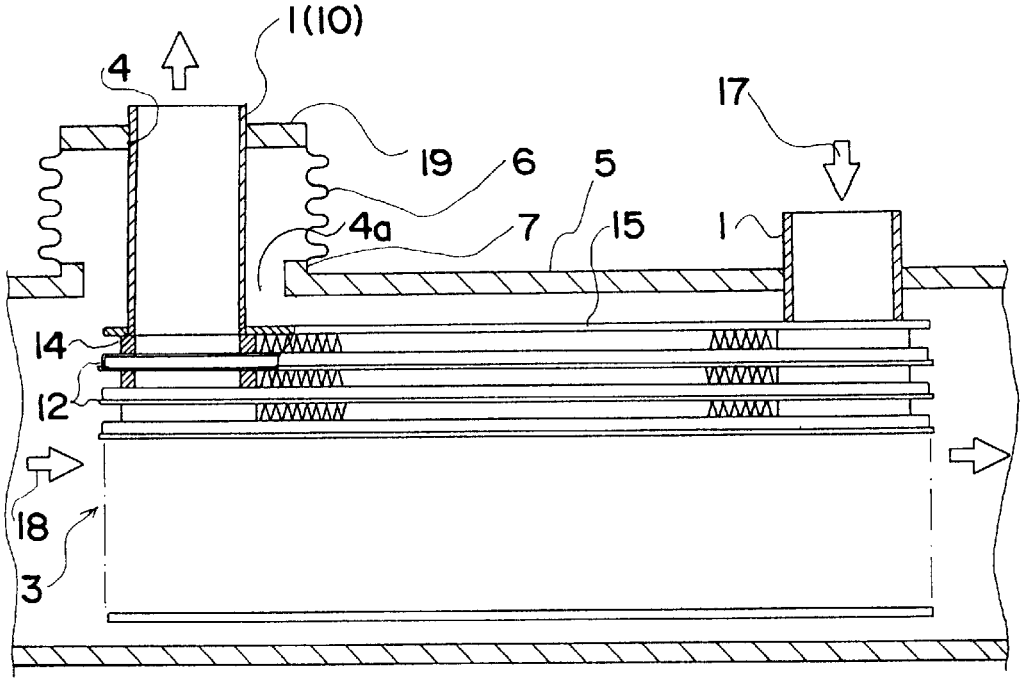
FIG. 3 is a longitudinal sectional view of a second embodiment of the heat exchanger of the present invention.

FIG. 3 shows a second embodiment of the heat exchanger of the present invention, which is adapted to treat a highly pressurized fluid passing through the core 3. This second embodiment differs from the first embodiment of the present invention in that: the second embodiment has the left-hand one of the inlet/outlet convex portions 1 constructed of a pipe member 10; and, a flange member 19 in the second embodiment is fixedly and integrally mounted on an upper end portion of the pipe member 10. In the second embodiment shown in FIG. 3, the bellows 6 is interposed between: an end portion of the short sleeve-like portion 7 of the casing 5; and, an outer peripheral edge portion of the flange member 19 fixedly mounted on the upper end portion of the pipe member 10, wherein the short sleeve-like portion 7 projects outward from the peripheral edge portion of an insertion portion 4a of the casing 5, as shown in FIG. 3. Since the second embodiment of the heat exchanger of the present invention has the above construction, there is no fear that the bellows 6 is subjected to the pressure of the highly pressurized fluid such as the first fluid 17 passing through the core 3. In operation, a difference in thermal expansion between the core 3 and the casing 5 is absorbed by such a flexible bellows 6. Incidentally, although the bellows 6 is disposed in the outlet side of the first fluid 17 in each of the first and the second embodiment of the present invention, it is also possible for the bellows 6 to be disposed in the inlet side of the first fluid 17. Furthermore, it is also possible to provide the bellows 6 in each of the outlet and the inlet side of the first fluid 17.

Figure 4:
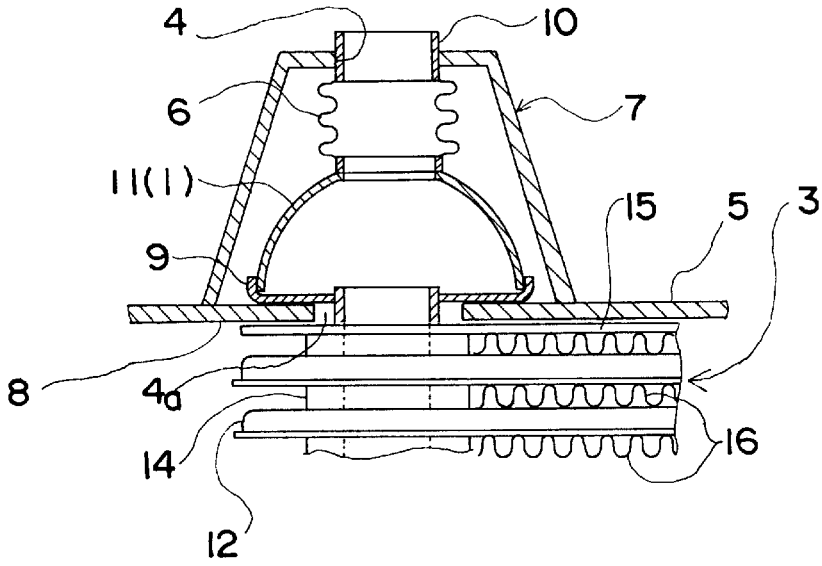
FIG. 4 is a longitudinal sectional view of a third embodiment of the heat exchanger of the present invention.

Next, a third embodiment of the heat exchanger of the present invention is shown in FIG. 4. More specifically, in the third embodiment, an inner flange portion 8 of the casing 5 is provided in the root portion of the sleeve-like portion 7 of the casing 5 of the first embodiment of the present invention shown in FIG. 1 to form the third embodiment shown in FIG. 4. In this third embodiment, as is clear from FIG. 4, the inner flange portion 8 is sandwiched between: the upper end plate 15 of the core 3; and, a flat surface portion (i.e., flange member 9) of a small reservoir portion 11. In order words, the inner flange portion 8 of the casing 5 is held by holding means 9, 15, wherein the holding means 9, 15 is constructed of the upper end plate 15 of the core 3 and the flat surface portion (i.e., flange member 9) of the small reservoir portion 11, as is clear from FIG. 4. In the third embodiment of the present invention having the above construction, the small reservoir portion 11 is laterally slidable relative to the inner flange portion 8 of the casing 5. Incidentally, in this third embodiment shown in FIG. 4, the sleeve-like portion 7 assumes a circular truncated cone shape. Consequently, in operation, the root portions of the inlet/outlet convex portions 1 in the third embodiment of the present invention shown in FIG. 4 are free from any bending moment resulted from a difference in thermal expansion between the components of the heat exchanger.

Figure 6:
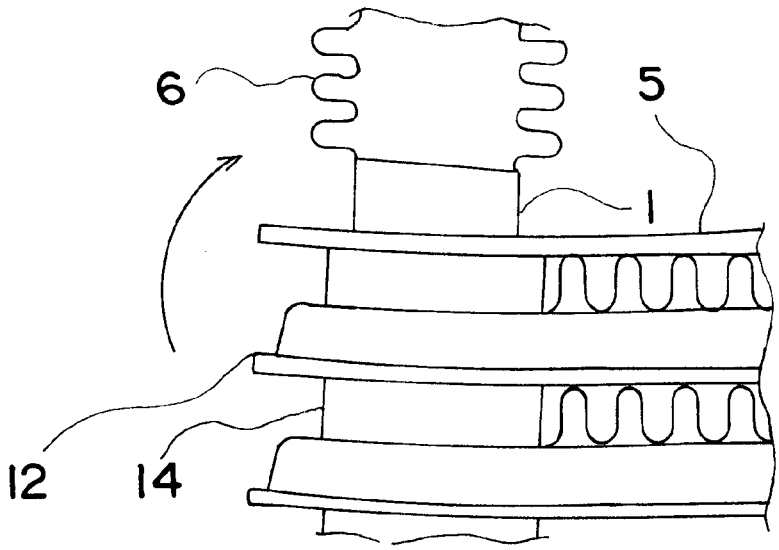
FIG. 6 is an enlarged longitudinal sectional view of an essential art of each of the third and the fourth embodiment of the present invention shown in FIGS. 4 and 5, respectively, illustrating the bending moment (expressed by the arrow) to which the third and the fourth embodiment of the present invention not provided with the holding means (9, 15) are subjected.

In other words, in case that the holding means 9, 15 is not provided in the heat exchanger of the present invention, as is clear from FIG. 6, the inlet/outlet convex portion 1 is also deformed when the bellows 6 is deformed. As a result of such a deformation of the inlet/outlet convex portion 1, the root portion of the inlet/outlet convex portion 1 is subjected to a considerably large amount of bending moment (expressed by the arrow of FIG. 6). As is clear from this fact, it is recognized that the holding means 9, 15 is capable of effectively minimizing such bending moment.

Figure 5:
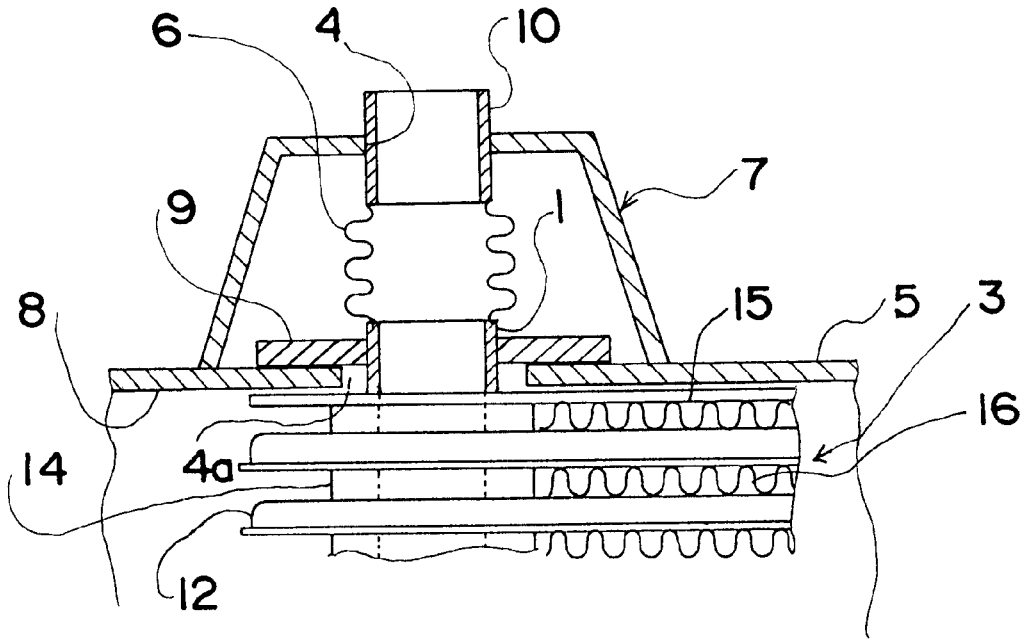
FIG. 5 is a longitudinal sectional view of a fourth embodiment of the heat exchanger of the present invention, illustrating the holding means (9, 15) constructed of the flange (9) member provided in an outer peripheral portion of the inlet/outlet convex portion (1) and the upper end plate (15) of the core (3)

FIG. 5 is a fourth embodiment of the heat exchanger of the present invention, in which the holding means 9, 15 is constructed of: the flange member 9 mounted on an outer peripheral portion of the inlet/outlet convex portion 1; and, the upper end plate 15 of the core 3 to permit the inner flange portion 8 of the casing 5 to laterally slidably move relative to the holding means 9, 15.

Now, the action and the effect of the present invention will be described.

The bellows 6 of the heat exchanger of the present invention having the above construction is capable of sufficiently absorbing any difference in thermal expansion between the core 3 and the casing 5 even when a difference in length between the core 3 and the casing 5 is produced due to their thermal expansion.

Further, as is clear from FIG. 1, the heat exchange of the first embodiment of the present invention is provided with the bellows 6 between the top opening portion of the short sleeve portion 7 of the casing 5 and the inlet/outlet convex portion 1 of the core 3, it is possible to prevent the bellows 6 from being exposed outward. Further, it is also possible to permit the bellows 6 to be smoothly deformed within the short sleeve portion 7 of the casing 5, which makes it possible to sufficiently absorb any difference in thermal expansion between the core 3 and the casing 5.

Further, in the second embodiment of the present invention shown in FIG. 3, since the bellows 6 has one of its opposite end portions brought into fluid-tight contact with the outer peripheral portion of the inlet/outlet convex portion 1 through the flange member 19, there is no problem even when a highly pressurized fluid is introduced into the core 3. In other words, the construction of the heat exchanger of the present invention shown in FIG. 3 is capable of minimizing any stress imposed on the bellows 6.

The third embodiment of the heat exchanger of the present invention is provided with the holding means 9, 15 in the root portion of the inlet/outlet convex portion 1 of the core 3. Since such a holding means 9, 15 is slidably movable relative to the inner flange portion 8 of the casing 5, it is possible for the resiliency of such a bellows 6 to minimize any bending moment appearing in the root portion of the inlet/outlet convex portion 1 of the core 3, which improves the root portion of the inlet/outlet convex portion 1 of the core 3 in reliability.

Finally, the present application claims the Convention Priority based on Japanese Patent Application No. Hei 11-139922 filed on May 20, 1999, which is herein incorporated by reference.

What is claimed is:

1. A heat exchanger comprising:

a core (3) provided with a pair of inlet/outlet convex portions (1), wherein said inlet/outlet convex portions (1) are longitudinally spaced apart from each other on an outer peripheral surface of said core (3);

a casing (5) for receiving therein said core (3), wherein said casing (5) is provided with a pair of through-hole portions (4) which are brought into liquid-tight contact with said inlet/outlet convex portions (1) of said core (3), wherein a first fluid (17) and a second fluid (18) are introduced into said core (3) and said casing (5), respectively, to perform heat exchange between said first fluid (17) and said second fluid (18); and a bellows (6) interposed between at least one of said inlet/outlet convex portions (1) of said core (3) and a corresponding one of said through-hole portions (4) of said casing (5) to realize fluid-tight contact between said bellows and each of said one of said inlet/outlet convex portions (1) of said core (3) and said corresponding one of said through-hole portions (4) of said casing (5), wherein said bellows (6) permits said one of said inlet/outlet convex portions (1) of said core (3) to move relative to said corresponding one of said through-hole portions (4) of said casing (5) in a radial direction of said corresponding one of said through-hole portions (4) of said casing (5), wherein: a short sleeve portion (7) larger in diameter than said one of said inlet/outlet convex portions (1) of said core (3) is provided in a position corresponding to that of said corresponding one of said through-hole portions (4) of said casing (5); said short sleeve portion (7) of said casing (5) has its top opening portion brought into fluid-tight contact with one of opposite ends of said bellows (6), the other one of said opposite ends of said bellows (6) being brought into fluid-tight contact with said one of said inlet/outlet convex portions (1) of said core (3), and wherein: said short sleeve portion (7) of said casing (5) is provided with an inner flange portion (8) in its root portion; and, a holding means (9, 15) for slidably holding said inner flange portion (8) of said casing (5) is provided in the root portion of said one of said inlet/outlet convex portions (1) of said core (3).

2. A heat exchanger comprising:

a core (3) provided with a pair of inlet/outlet convex portions (1), wherein said inlet/outlet convex portions (1) are longitudinally spaced apart from each other on an outer peripheral surface of said core (3);

a casing (5) for receiving therein said core (3), wherein said casing (5) is provided with a pair of through-hole portions (4) which are brought into liquid-tight contact with said inlet/outlet convex portions (1) of said core (3), wherein a first fluid (17) and a second fluid (18) are introduced into said core (3) and said casing (5), respectively, to perform heat exchange between said first fluid (17) and said second fluid (18); and a bellows (6) interposed between at least one of said inlet/outlet convex portions (1) of said core (3) and a corresponding one of said through-hole portions (4) of said casing (5) to realize fluid-tight contact between said bellows and each of said one of said inlet/outlet convex portions (1) of said core (3) and said corresponding one of said through-hole portions (4) of said casing (5), wherein said bellows (6) permits said one of said inlet/outlet convex portions (1) of said core (3) to move relative to said corresponding one of said through-hole portions (4) of said casing (5) in a radial direction of said corresponding one of said through-hole portions (4) of said casing (5), wherein: a short sleeve portion (7) larger in diameter than said one of said inlet/outlet convex portions (1) of said core (3) is provided in a position corresponding to that of said corresponding one of said through-hole portions (4) of said casing (5); said short sleeve portion (7) of said casing (5) has its top opening portion brought into fluid-tight contact with one of opposite ends of said bellows (6), the other one of said opposite ends of said bellows (6) being brought into fluid-tight contact with said one of said inlet/outlet convex portions (1) of said core (3), wherein: said short sleeve portion (7) of said casing (5) is provided with an inner flange portion (8) in its root portion; and, a holding means (9, 15) for slidably holding said inner flange portion (8) of said casing (5) is provided in the root portion of said one of said inlet/outlet convex portions (1) of said core (3), and wherein said holding means (9, 15) is constructed of a flange member (9) and an upper end plate (15) of said core (3).

3. The heat exchanger as set forth either claim 1 or claim 2, wherein said short sleeve portion (7) of said casing (5) assumes a circular truncated cone shape.

* * * * *